US006342042B1

(12) United States Patent
Martin

(10) Patent No.: US 6,342,042 B1
(45) Date of Patent: Jan. 29, 2002

(54) ADJUSTABLE AMPLITUDE EXERCISER WITH FOOT CRADLE

(76) Inventor: Ivan Z. Martin, 739 Hilltop Rd., Myerstown, PA (US) 17067

( * ) Notice: Subject to any disclaimer, the term of this patent is extended or adjusted under 35 U.S.C. 154(b) by 0 days.

(21) Appl. No.: 09/837,837

(22) Filed: Apr. 18, 2001

(51) Int. Cl.[7] ..... A61H 1/00

(52) U.S. Cl. ..... 601/93; 601/84; 601/89; 74/47

(58) Field of Search ..... 601/97–98, 101, 601/46, 67, 69–70, 23, 25, 27, 84, 49, 92; 74/47

(56) References Cited

U.S. PATENT DOCUMENTS

| | | | | |
|---|---|---|---|---|
| 5,107,822 A | | 4/1992 | Ohashi | 128/25 |
| 5,328,443 A | | 7/1994 | Lee | 601/92 |
| 5,372,563 A | | 12/1994 | Chien-nan | 601/27 |
| 5,411,469 A | | 5/1995 | Wang | 601/92 |
| 5,417,644 A | | 5/1995 | Lee | 601/98 |
| 5,419,753 A | | 5/1995 | Wang | 601/84 |
| 5,468,215 A | | 11/1995 | Park | 601/23 |
| 5,489,257 A | | 2/1996 | Li | 601/98 |
| 6,056,706 A | * | 5/2000 | Hung | 601/89 |

* cited by examiner

*Primary Examiner*—Mickey Yu
*Assistant Examiner*—Quang D Thanh
(74) *Attorney, Agent, or Firm*—Martin Fruitman

(57) ABSTRACT

The apparatus is a foot exerciser which swings the feet with an electric motor driven rotating cam with holes spaced at different distances from the drive shaft. The cam has a drive link attached at one of the holes and the drive link is also attached to one swinging arm of a parallelogram structure to which an oscillating foot cushion is attached. Moving the drive link attachment between holes on the rotating cam or between several holes along the length of the swinging arm changes the amplitude of oscillation of the foot cushion.

3 Claims, 1 Drawing Sheet

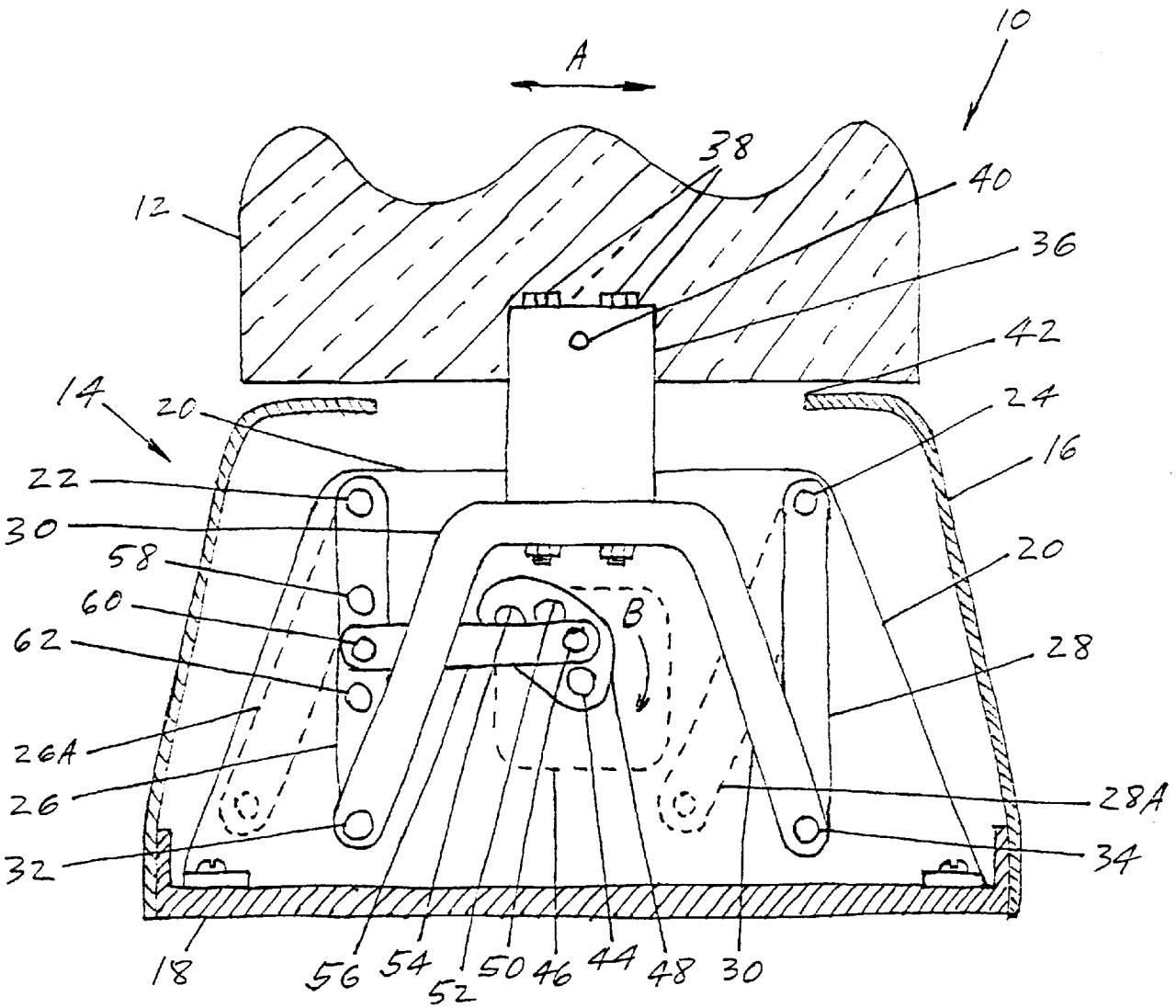
10
40
36
42
24
16
20
28
28A
34
38
A
B
30
48
44
46
50
52
54
56
18
12
20
14
22
30
58
60
62
26A
26
32

ADJUSTABLE AMPLITUDE EXERCISER WITH FOOT CRADLE

BACKGROUND OF THE INVENTION

This invention deals generally with exercise devices and more specifically with a footstool type device which subjects the user's feet and ankles to a swinging motion.

There is significant interest developing in swinging exercise devices that are virtually unknown in mainstream culture. The devices look very much like footstools except that they typically have two depressions in their top surface, and the depressions are shaped like half cylinders. The devices are actually swinger devices, and they are used to swing the user's feet and ankles. The footrest of the device is set on top of a swinger enclosure; the footrest cushion is typically a soft material covered by vinyl; and the two half cylinder depressions are used to support the user's feet or ankles. The devices are used by resting on a flat surface and placing the feet or ankles on the support depressions on the footrest cushion while supplying electrical power to a swinging assembly within the enclosure which supports the footrest cushion.

Several patents have been granted on such devices. U.S. Pat. Nos. 5,468,215 to Park, 5,411,469 to Wang, and 5,328,433 to Lee all show parallelogram structures which are used to move the footrest back and forth. However, all of these prior art devices lack one feature. None of the prior art patents suggest any means for varying the amplitude of the vibration to which the user is subjected although such an adjustment would be very desirable. The ability to adjust the vibration amplitude would be very helpful for users such as those who are arthritic or have limited mobility for other reasons, and to whom the fixed amplitudes now available are excessive. With a means to adjust the amplitude of the vibration, such users can initially use a smaller amplitude vibration, and, as their range of mobility increases they can adjust the swinger to have a greater amplitude.

SUMMARY OF THE INVENTION

The present invention provides a foot and ankle swinging device with the capability of changing the amplitude of oscillation. The foot swinger is built upon a horizontal support base which acts as the bottom of the swinger enclosure and the support structure for all the other components. The mechanism which produces the oscillatory motion for the footrest cushion is supported from the upper portion of a vertical support plate extending from side to side in the swinger. The actual motion produced within the swinger is also side to side, that is, in a direction parallel to the diameters of the two half cylinder depressions in the padded footrest of the swinger and across the direction of the legs of the user. Thus the motion imparted to the user's ankles is a motion transverse to the normal walking motion of the legs.

The swinger structure is based upon a swing-like parallelogram structure hung from the vertical support structure located approximately midway between the front and back of the swinger. In the preferred embodiment, the vertical support structure is a plate which has two bearings attached near the top of the vertical plate with the two bearings separated by a substantial portion of the width of the swinger. A swinging arm is hung from each of these bearings. The arms are of equal length, their bottom ends approach the bottom support base plate of the entire unit, and a pivot point is attached near the bottom of each arm with the pivot points at equal distances from the bearings. A bridge structure spans the distance between the swinging arms and is attached to the arms at their pivot points. Thus, the arms and bridge structure form a parallelogram and can swing back and forth together and move the bridge structure back and forth in a path parallel to the vertical support structure and side to side of the swinger.

Motion is imparted to the parallelogram through a speed reducing gearbox by an electric motor. In the preferred embodiment, the motor is located on the opposite side of the vertical support structure from the parallelogram structure, and the drive shaft protrudes through the vertical support structure. The drive shaft has a rotating cam attached, and a drive link is attached between the rotating cam and one of the swinging arms of the parallelogram structure. The attachment point of the drive link to the rotating cam is offset from the rotating shaft by a short distance. Thus, as the drive shaft and cam rotate, the point at which the drive link is connected to the swinging arm moves back and forth a distance which is twice the offset between the drive shaft and the point at which the drive rod is connected to the cam. The entire parallelogram structure then moves back and forth a distance determined by the point at which the drive link is attached to the swinging arm. In the preferred embodiment of the invention the motion of the parallelogram and the foot cushion is variable between 1⅛ and 1⅝ inches.

It is this variability of the oscillation amplitude which is not available in the prior art devices. The adjustment of the oscillation amplitude is accomplished quite simply by either of two mechanisms. In one, the cam simply has several connection points, such as holes, at different distances from its connection point to the drive shaft, and the adjustment is accomplished by moving the drive link connection from one hole to another. As the connection point is changed the oscillatory motion changes by twice the distance between the two connection holes. Thus, all that is required to change the amplitude of the oscillation is to open the case of the swinger assembly, remove the nut on the screw holding the drive link to the cam, and change the hole in the cam at winch the drive link is connected.

The second method of changing the amplitude of oscillation is also very simple. It only involves moving the connection point between the drive link and the swinging arm closer to or farther away from the point at which the swinging arm is connected to its top bearing at the vertical support plate. This is facilitated by several holes formed along the length of the swing arm so that the bolt connecting the drive link can be moved from one hole to another to change the amplitude of oscillation.

These simple changes can easily be accomplished by the average user of the foot swinger, and since it is not a frequently required change, the several steps to accomplish it are not a hardship.

BRIEF DESCRIPTION OF THE DRAWINGS

The FIGURE is a partial cross section front view of the interior of the preferred embodiment of the invention.

DETAILED DESCRIPTION OF THE INVENTION

The FIGURE is a partial cross section front view of the preferred embodiment of foot swinger 10 in which cushion 12 atop foot swinger 10 is moved back and forth in the direction indicated by arrow A by swinger assembly 14. Swinger assembly 14 is mounted within enclosure 16 upon horizontal base 18 to which a vertical support structure such as vertical plate 20 is attached. Vertical plate 20 has two bearings 22 and 24 mounted near its top, located at equal distances above base 18, and separated by a substantial distance.

Swinging arms 26 and 28 are hung from bearings 22 and 24 respectively, and bridge 30 is attached near the bottoms of swinging arms 26 and 28 at pivot points 32 and 34 to interconnect swinging arms 26 and 28. Pivot points 32 and 34 are located at equal distances from the bearings on their respective swinging arms. The top of vertical support 20, swinging arms 26 and 28, and bridge 30 thereby form a hanging parallelogram structure which, although shown in the vertical position in the FIGURE, can be moved to the right or left. A position to the left is shown in dashed lines by alternate swinging arm positions 26A and 28A.

As the parallelogram structure moves to the right and left in the FIGURE, bridge 30 follows the same movement, and cushion 12, which is attached to bridge 30, moves along with bridge 30. Cushion 12 can be attached to bridge 30 by any conventional means, but is shown in the FIGURE with block 36 fitted into cushion 12 and bolts 38 attaching block 36 to bridge 30. Cushion 12 is held onto block 36 by a screw (not shown) which penetrates the side of cushion 12 and enters hole 40 in block 36. Block 36 moves right and left in slot 42 in the top of enclosure 16.

The swinging motion is imparted to the parallelogram structure by drive shaft 44 which is driven by gearbox 46 located behind vertical plate 20. Gearbox 46 is itself driven by an electric motor (not shown) which is also typically on the far side of vertical plate 20. The rotation of drive shaft 44 is converted into linear motion by rotating cam 48 and drive link 50. Cam 48 includes at least two rotating connection points such as holes 50, 52, and 54, and cam 48 is attached to drive shaft 44 and rotates with it. As cam 48 rotates, holes 50, 52, and 54, each at different distances from drive shaft 44, rotate around the center of drive shaft 44 on circles with different diameters. Drive link 56 is always connected to cam 48 at one of the holes 50, 52, and 54. In the FIGURE the rotating connection point is shown at hole 50.

The other end of drive link 56 is connected to swinging arm 26 at one of at least two pivoting connection points such as holes 58, 60, and 62 which are spaced along the length of swinging arm 26. In the FIGURE the pivoting connection point is shown at hole 60. As can easily be appreciated from the FIGURE, as cam 48 rotates in the direction of arrow B shown, drive link 56 will move to the right and cause swinging arm 26 and, in fact the entire parallelogram structure and cushion 12 to also move to the right.

Thus, the several holes on cam 48 and the several holes on swinging arm 26 are the means for adjusting the amplitude of oscillation of cushion 12. As the connection point of drive link 56 at cam 48 is moved from, for example hole 50 to hole 54, the motion of drive link 56 is increased because the circle upon which the connection point moves has a greater diameter, and this greater motion is transmitted to cushion 12.

The adjustment of the amplitude of oscillation at swinging arm 26 is a bit more subtle than at cam 48. At swinging arm 26, moving the connection point of drive link 56 from hole 60 to, for example, hole 58 will increase the amplitude of oscillation of cushion 12 because the ratio of the radii between the motion of drive link 56 and that of bridge 30, which is attached at the far end of swinging arm 26, changes.

It should be appreciated that the actual means for connecting drive link 56 to cam 48 and to swinging arm 26 are not pictured in the FIGURE, both because they would interfere with the view of the connection points and because they can be any of many conventional devices. Perhaps the most common is a simple screw and nut, but other connection devices such as cotter pins or spring clips could also be used. Regardless of the specific connection means used, all that is required to adjust the amplitude of the oscillation of cushion 12 is to open enclosure 16 of the swinger assembly and to move one end or the other of drive link 56 to another connection point. The invention thereby provides a foot swinger which can be adjusted for the capabilities of the user.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, cushion 12 could be connected to bridge 30 by many conventional devices such as brackets or threaded connections molded directly into cushion 12.

What is claimed as new and for which Letters Patent of the United States are desired to be secured is:

1. A foot swinger with adjustable amplitude of oscillation comprising:

a base structure;

a vertical support structure attached to the base structure and including two bearings spaced from each other and located at equal distances above the base structure;

a swinging arm hanging from each of the two bearings on the vertical structure, each swinging arm including a lower pivot point with the lower pivot points on the two swinging arms located at the same distance above the base structure;

a bridge attached to and connecting the lower pivot points on the two swinging arms;

a drive link connected to one of the swinging arms at a pivoting connection point and connected at a rotating connection point on a rotating cam which has at least two rotating connection points to which the drive link can be connected, with each rotating connection point at a different radial distance from a drive shaft which rotates the cam;

a rotating drive shaft connected to the rotating cam and driven by a motor installed within the foot swinger; and a foot cushion interconnected to and moving with the bridge.

2. The foot swinger of claim 1 wherein the bridge is shaped to extend upward toward the foot cushion.

3. A foot swinger with adjustable amplitude of oscillation comprising:

a base structure;

a vertical support structure attached to the base structure and including two bearings spaced from each other and located at equal distances above the base structure;

a swinging arm hanging from each of the two bearings on the vertical structure, each swinging arm including a lower pivot point with the lower pivot points on the two swinging arms located at the same distance above the base structure;

a bridge attached to and connecting the lower pivot points on the two swinging arms;

a drive link connected to one of the swinging arms at one of at least two pivoting connection points with each pivoting connection point located at a different distance from the bearing from which the swinging arm is hanging;

a rotating cam connected to the drive link at a rotating connection point;

a rotating drive shaft connected to the rotating cam and driven by a motor installed within the foot swinger; and a foot cushion interconnected to and moving with the bridge.

* * * * *